US005251385A

United States Patent [19]

Secor et al.

[11] Patent Number: 5,251,385

[45] Date of Patent: Oct. 12, 1993

[54] METHOD OF HEATING A GRAIN DRYER AND APPARATUS THEREFOR

[76] Inventors: John Secor, 4556 S. Kear Rd.; James Luffman, 6000 Monks Rd., both of Canandaigua, N.Y. 14424

[21] Appl. No.: 729,593

[22] Filed: Jul. 15, 1991

[51] Int. Cl.[5] ..... F26B 19/00

[52] U.S. Cl. ..... 34/86; 110/102; 110/229; 34/181

[58] Field of Search ..... 34/86, 182, 181, 135, 34/136, 218, 22, 35; 110/229, 233, 102

[56] References Cited

U.S. PATENT DOCUMENTS

| | | | |
|---|---|---|---|
| 4,139,952 | 2/1979 | Stanfield | 34/218 |
| 4,452,611 | 6/1984 | Richey | 110/229 |
| 4,463,687 | 8/1984 | Zimmerman et al. | 110/233 |
| 4,509,273 | 4/1985 | Roisen | 34/86 |
| 4,517,903 | 5/1985 | Richmond et al. | 110/102 |
| 4,543,890 | 10/1985 | Johnson | 110/102 |
| 4,821,428 | 4/1989 | Good | 34/86 |

*Primary Examiner*—Henry A. Bennet
*Assistant Examiner*—Denise L. Gromada
*Attorney, Agent, or Firm*—Hoffman Stone

[57] ABSTRACT

A stove for burning corn (maize) including a heat exchanger having an input chamber in which corn is burned, and an output chamber where heat from the burning corn is absorbed in air, which is directed to a conventional grain drying machine for drying the grain therein. Unique arrangements are made for optimizing the quantity of air admitted to the input chamber for combustion, and for making the flow of combustion air uniform across the entire mass of burning corn. An auger is included for feeding corn to the input chamber either from a separate supply vessel, or, in cases where corn is the grain to be dried, from the grain dryer itself.

6 Claims, 3 Drawing Sheets

METHOD OF HEATING A GRAIN DRYER AND APPARATUS THEREFOR

This invention relates to a novel method of heating a grain dryer, and to improved, novel apparatus therefor.

Heretofore, heat sources for grain dryers have commonly been propane or petroleum burners, or other conventional sources. Also, U.S. Pat. No. 4,509,273, to Roisen teaches burning field waste, particularly corn cobs, stalks, and the like.

Propane and other conventional fuels are currently relatively expensive, and burning field waste as taught by Roisen entails a great deal of inconvenience and expense such that few farmers are willing to undertake it.

BRIEF DESCRIPTION

Briefly, according to the invention, heat for drying grain is generated by burning maize, usually called corn in America, and a specially designed burner has been developed to ensure even burning of the corn even though it may contain fines, broken pieces, and other contaminating matter that would interfere with its satisfactory burning in a corn fired stove of previously known kind.

Corn is found to be a significantly less expensive fuel than propane, or any of the other conventional fuels, especially in view of the currently depressed price of the grain. Moreover, with the apparatus of the invention, operation is very simple and convenient. When corn is the grain being dried, fuel for heating may be taken directly from the grain dryer, and when some other grain is to be dried it is a simple matter to provide a separate container for the corn. Further, ventilation for providing combustion air is, in most case, taken care of by the fan that is included as an essential part of most grain drying machines, so that the apparatus need only include adequate flow controls and the like. The only direct power requirement is the need to drive a conveyor machine or some sort to move the fuel corn from its container to the fire pot, and this is only a small requirement.

The apparatus of the invention is designed to optimize the volume and uniformity of flow of combustion air to the burning corn and also to distribute the fuel corn uniformly over the fire grate. Burning corn requires a relatively large amount of air, and it has been found to be important that no part of the corn in the fire grate be blocked off from the combustion air, else pockets of unburned corn may develop making for unevenness of heat flow. In particular, a firepot having perforated bottom and side walls is mounted as the combustion chamber within a secondary chamber, or duct, that feeds heated air directly to the grain dryer. The effluent from the corn fire is smokeless and is fed directly into the stream of heated air that flows into the grain dryer. The fuel corn is delivered by an auger from its source, which may be the grain dryer itself, through an inlet at the top of the combustion chamber to a dispersing deflector which acts to disperse the corn evenly over the fire grate. The air flow driven by the fan of the grain dryer is downwardly in the region where the fuel corn falls from the auger into the firebox so there is no tendency for the corn to ignite before it reaches the grate.

DETAILED DESCRIPTION

A representative embodiment of the invention will now be described in conjunction with the drawings, wherein.

Figure 1:
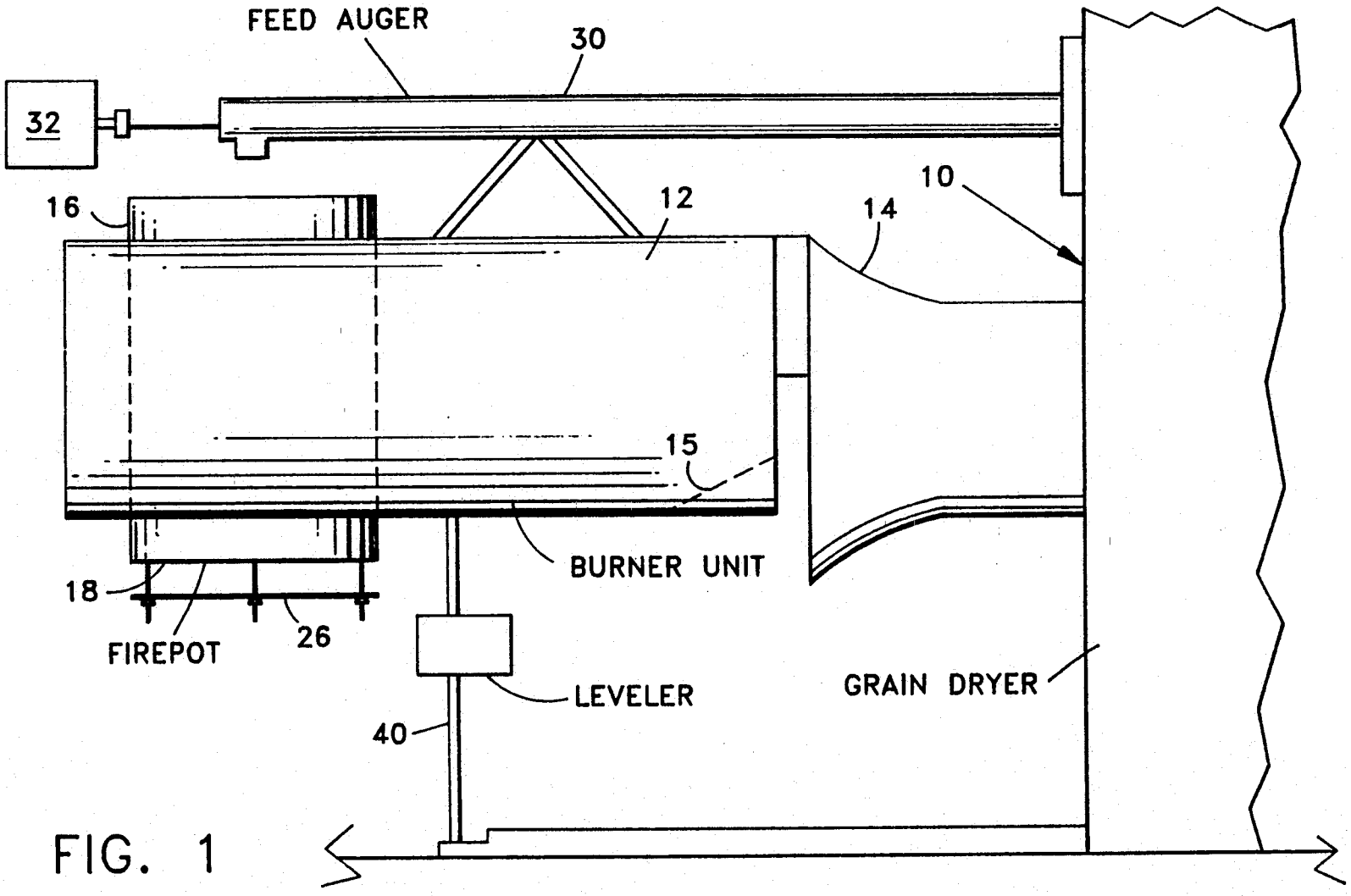
FIG. 1 is a side elevational view in schematic form of a burner unit according to a presently preferred embodiment of the invention.

Referring now to the drawings, the burner of the invention is shown as used for feeding hot, grain-drying air to a grain dryer 10 of any desired kind. The actual dryer used in the development of the invention was made my the Matthews Company, of Crystal Lake, Ill., Model MC-250E.

The secondary chamber 12 of the burner was constituted by a conventional fuel oil tank of 275 gallon capacity turned on its side with its right hand end, as viewed in FIG. 1, cut out, and provision made for mounting certain other parts as described hereinafter. The open right hand end of the chamber 12 is positioned to confront the open inlet fairing 14 of the dryer 10 so that the fan (not shown) of the dryer 10 provides a relatively strong suction to draw air through the burner.

A deflector 15 is fixed inside the chamber 12 at its front end to divert heated air away from the blower fan motor (not shown) of the dryer 10. The position of the deflector 15 depends on the construction of the dryer and the position of the motor that drives its blower fan. In some cases where the blower motor is adequately protected otherwise the deflector may not be needed.

The combustion chamber 16 of the burner extends vertically through the secondary chamber 12 and is made of a standard 55 gallon drum with its bottom removed and substituted by the bottom 18 of a 30 gallon drum.

Figure 3:
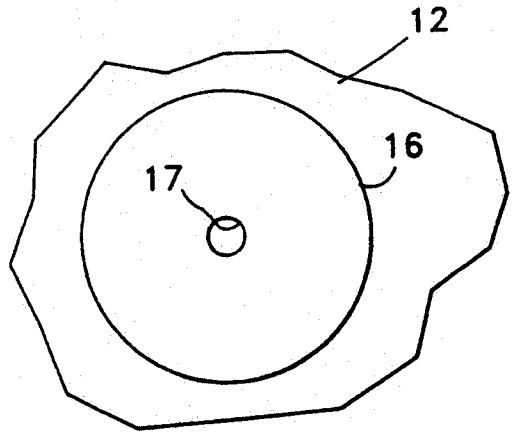
FIG. 3 is a plan view of the cover for the input chamber of the heat exchanger of the burner shown in FIGS. 1 and 2.

As seen in FIG. 3, a central hole 19 about six inches in diameter is cut in the lid 21 of the drum that constitutes the combustion chamber 16 for admitting fuel corn to the chamber.

Figure 4:
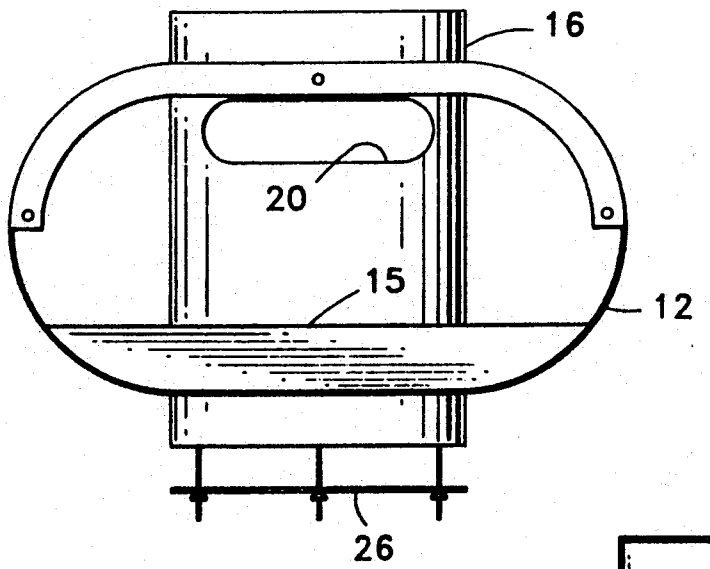
FIG. 4 is a front elevational view of the burner, with certain parts being omitted for clarity.

As best seen in FIG. 4, an effluent opening 20 is cut in the front wall of the chamber 16 near its upper end and opening into the secondary chamber so that suction from the dryer 10 is applied throughout the entire interior of the combustion chamber. In practice, by trial and error it was found that an opening about 18" wide by 5" high, placed in the front wall near the top of the chamber 16 provided near optimum result.

Figure 2:
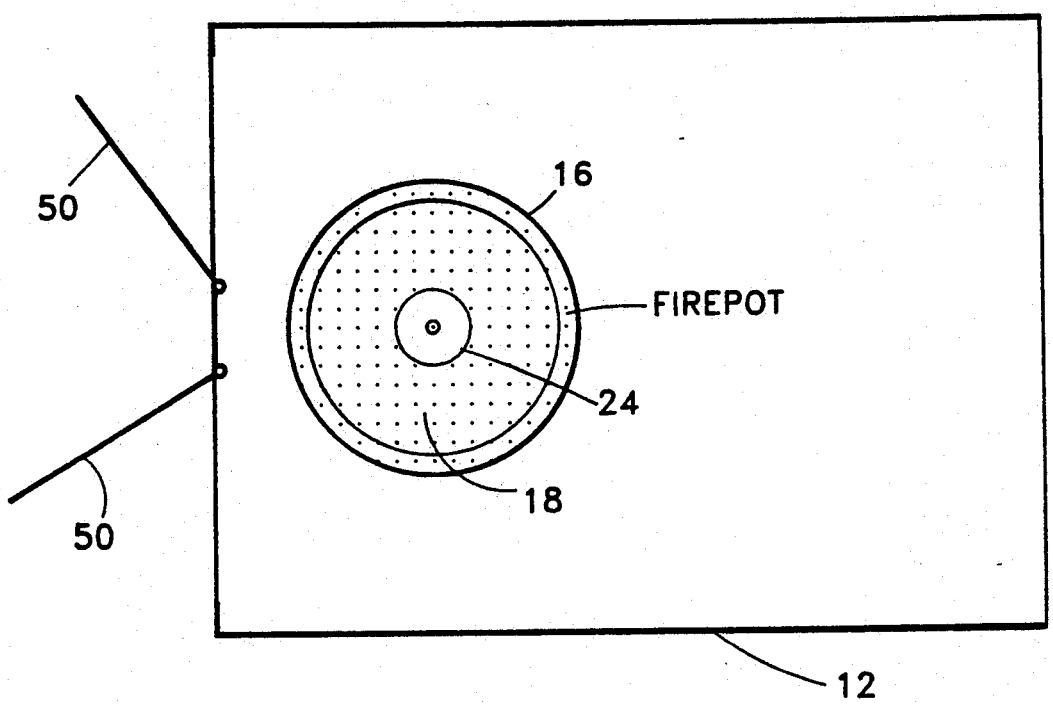
FIG. 2 is a plan view of the burner shown in FIG. 1, with the auger and the cover of the input chamber of the heat exchanger removed.
Figure 6:
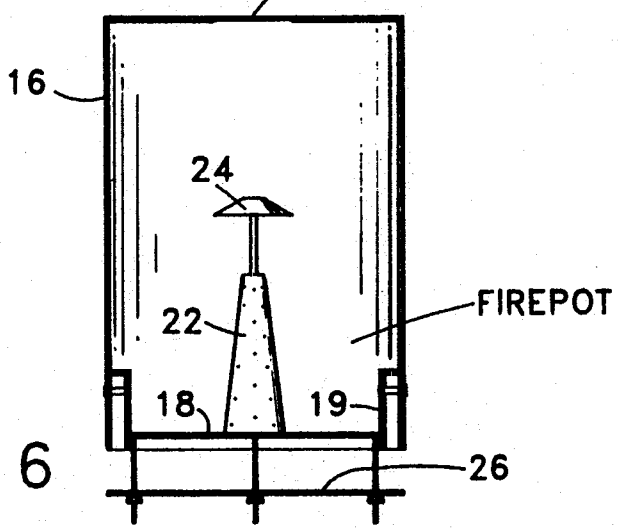
FIG. 6 is a longitudinal sectional view of the input chamber of the burner shown in the previous Figures.

The bottom 18 of the combustion chamber is the fire grate. It includes not only the bottom of the 30 gallon drum but also a part 19 of its sidewall. It is perforated over its entire area, including the sidewall portion 19, as best seen in FIGS. 2 and 6, to allow adequate amounts of air to be admitted to the fire pot, and to maintain a uniformity of flow across its entire horizontal section. In addition, a perforated cone 22 is mounted at the center of the grate 18 for admitting combustion air right at the center of the burning mass of corn, and a circular deflector 24 is mounted atop the cone 22 for dispersing the corn as it falls into the fire pot. It was found that the optimum hole size for the perforations is about 5/32 inch diameter. The amount of combustion air flowing into the fire pot may be further controlled by a damper 26 which is adjustably suspended beneath the chamber 16. Raising the damper 26 reduces the amount of air admitted.

A feed auger 30, driven by a motor 32 is mounted above the heat exchanger 12 for delivering corn at a controllable rate to the input chamber 16. When the grain being dried is corn the auger is mounted to take the corn directly from the dryer 10. The dryer shown is of the kind wherein the corn moves downwardly through a drying chamber, losing moisture as it descends. The input end of the auger 30 is inserted into the drying chamber at the point where the moisture content of the corn is about 20%.

In cases where grain other than corn is to be dried a separate container must be supplied for holding the fuel corn.

Figure 5:
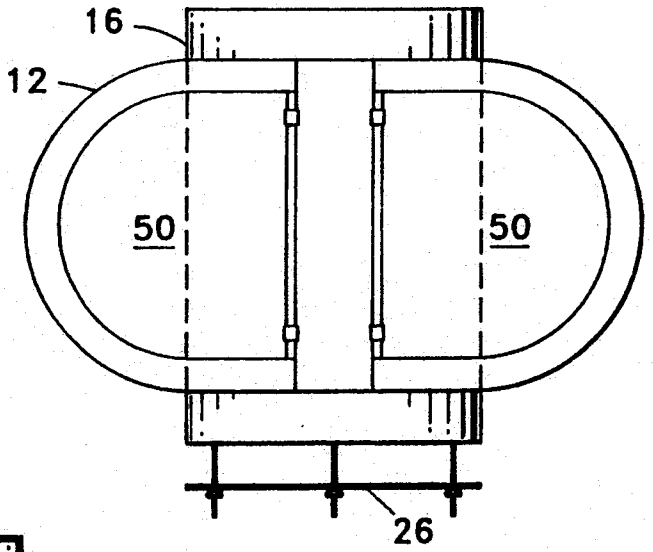
FIG. 5 is a rear view of the burner, again with certain parts removed for clarity.

A pair of air flow control doors 50 (FIGS. 2 and 5) are provided at the rear of the secondary, or output chamber of the burner for adjusting the amount or air drawn into it by-passing the input chamber 16, and a level adjusting rod 40, along with any other desired support means, is arranged as desired for maintaining the attitude of the burner.

It was also found that field corn with about 20% moisture, the content of the corn taken from the dryer, yields about 385,000 BTU's per bushel when burned in the burner shown. Corn with 20% moisture is currently available at about $74 per ton, which is considerably cheaper than fully dried corn. Even fully dried corn is substantially less expensive than propane, the usual fuel, and using corn with relatively high moisture provides additional savings. Moreover, relative to propane, the combustion product from burning corn contains significantly less water and is thus better able to contribute to the drying process than is propane, assuming that in both cases the combustion product is fed into the dryer along with a portion of the ambient air.

The equipment of the invention is also relatively simple and inexpensive, versatile and very easy and convenient to use. In addition, it is neat and clean, and produces very little residue.

What is claimed is:

1. A corn burner for supplying heat to a grain dryer of the kind having a chamber for holding grain to be dried and a blower for forcing air through the chamber and through grain therein, said burner comprising a cylindrical fire pot having perforated bottom and lower side walls arranged to serve as a fire grate, the perforations being sized to hold corn, a horizontal duct for guiding gases from said fire pot to one end of said duct, said fire pot being supported extending vertically through said duct with said perforated bottom and lower side walls protruding outside of and below said duct, the top of said fire pot extending through the top of said duct, and a lid for said fire pot, said lid having a centrally located hole for admitting corn to be burned in the fire pot, said fire pot also having an opening in an upper side wall thereof facing said one end of said duct for allowing free escape of combustion products from the fire pot into the duct, thence through the duct and out of said one end thereof when the duct is positioned with said one end facing the intake of the blower of the grain dryer so that in operation the blower of the dryer provides ample draft to ensure adequate burning of corn fed into the fire pot.

2. Apparatus according to claim 1 including also a perforated conical wall portion mounted within said fire pot centrally upon the bottom thereof for admitting combustion air into the central part of said fire pot.

3. A corn burner according to claim 2 wherein the perforations of said bottom and lower side walls of said fire pot are about 5/32nds inch in diameter.

4. Apparatus for drying grain according to claim 1 including further a conveyor device mounted above said fire pot and arranged to draw grain from a supply thereof and feed the drawn grain into said fire pot.

5. Apparatus for drying grain according to claim 4 wherein said conveyor is an auger.

6. Apparatus for drying grain according to claim 1 including damper means for controlling the flow of air into said fire pot and said duct.

* * * * *